US010718156B2

(12) United States Patent
Rupnow et al.

(10) Patent No.: US 10,718,156 B2
(45) Date of Patent: Jul. 21, 2020

(54) SHADE SYSTEM

(71) Applicant: InPro Corporation, Muskego, WI (US)

(72) Inventors: Calvin T. Rupnow, Cedarburg, WI (US); Matthew G. Bennett, New Berlin, WI (US); Megan N. Wylie, Milwaukee, WI (US)

(73) Assignee: InPro Corporation, Muskego, WI (US)

( * ) Notice: Subject to any disclaimer, the term of this patent is extended or adjusted under 35 U.S.C. 154(b) by 231 days.

(21) Appl. No.: 15/940,554

(22) Filed: Mar. 29, 2018

(65) Prior Publication Data

US 2019/0301239 A1 Oct. 3, 2019

(51) Int. Cl.

| | |
|---|---|
| ***E06B 9/42*** | (2006.01) |
| ***E06B 9/58*** | (2006.01) |
| *E06B 9/24* | (2006.01) |
| *E06B 9/00* | (2006.01) |

(52) U.S. Cl.

CPC ..... *E06B 9/42* (2013.01); *E06B 9/58* (2013.01); *E06B 2009/002* (2013.01); *E06B 2009/2482* (2013.01)

(58) Field of Classification Search

CPC ..... E06B 9/42; E06B 9/58; E06B 2009/2482; E06B 2009/002; E06B 9/581

USPC ..... 160/267.1

See application file for complete search history.

(56) References Cited

U.S. PATENT DOCUMENTS 1,912,579 A * 6/1933 Hamm ..... E06B 9/58 160/277
2,132,986 A * 10/1938 Julien ..... E06B 9/581 160/267.1
2,501,454 A * 3/1950 Schueren ..... E06B 9/54 160/273.1
2,689,004 A * 9/1954 Der Horst ..... E06B 9/17 160/269
6,691,761 B1 * 2/2004 Alkhoury ..... E06B 9/54 160/273.1
7,128,125 B2 * 10/2006 Harbison ..... E06B 9/42 160/273.1
7,360,575 B2 * 4/2008 Weiss ..... A47F 3/0469 160/264

(Continued)

FOREIGN PATENT DOCUMENTS

KR 20030025462 3/2003

*Primary Examiner* — Katherine W Mitchell

*Assistant Examiner* — Abe Massad

(74) *Attorney, Agent, or Firm* — Reinhart Boerner Van Deuren s.c.

(57) ABSTRACT

Embodiments of a shade system are provided. The shade system includes a first track assembly, a second track assembly, a shade, and a bottom rail. The track assemblies include tracks having an interior surface defined by a front wall, a rear wall, a sidewall, and two partitions. One of the partitions extends from the front wall, and the other of the partitions extends from the rear wall. A gap is provided between the two partitions. The track assemblies also include rods disposed within the tracks that do not contact the interior surfaces. The shade has outer loops wrapped around each rod and a bottom loop wrapped around the bottom rail. The bottom rail is connected to idler ends having loop portions around each respective rod. The bottom rail is disposed between the partitions. The idler ends are disposed within the tracks.

19 Claims, 7 Drawing Sheets

(56) References Cited

U.S. PATENT DOCUMENTS

| | | | | |
|---|---|---|---|---|
| 7,971,625 | B2 * | 7/2011 | Garmyn | E06B 9/327 160/277 |
| 8,887,789 | B2 * | 11/2014 | Tremaine, III | E06B 9/00 160/264 |
| 9,127,501 | B1 * | 9/2015 | Stobich | E06B 9/40 |
| 2007/0056696 | A1 | 3/2007 | Lin | |
| 2015/0308187 | A1 * | 10/2015 | Lu | E06B 9/42 160/319 |
| 2017/0159358 | A1 * | 6/2017 | Alonso Fabregat | E06B 9/581 |
| 2019/0226555 | A1 * | 7/2019 | Campagna | F16G 11/12 |

* cited by examiner

SHADE SYSTEM

BACKGROUND OF THE INVENTION

The present invention relates generally to the field of shade systems. The present invention relates specifically to anti-ligature shade systems usable in behavioral health facilities.

In behavioral health facilities, some patients are at risk of harming themselves and will use whatever objects that may be around them to that effect. Thus, in behavioral health facilities, structures and components must be designed to substantially limit their ability to be used by patients who may wish to harm themselves. Embodiments of the present invention relate to a shade system that addresses this need in the art.

SUMMARY OF THE INVENTION

One embodiment of the invention relates to a shade system. The shade system includes a first track assembly, a second track assembly, a shade, a bottom rail, and a security box. The first track assembly includes a first track having a first interior surface defined by a first front wall, a first rear wall, a first sidewall, and two first partitions. One of the first partitions extends from the first front wall, and the other of the first partitions extends from the first rear wall. A first gap is provided between the two first partitions. The first track assembly also includes a first rod disposed within the first track such that the first rod does not contact the first interior surface. The second track assembly includes a second track having second interior surface defined by a second front wall, a second rear wall, a second sidewall, and two second partitions. One of the second partitions extends from the second front wall, and the other of the second partitions extends from the second rear wall. A second gap is provided between the second partitions. The second track assembly also includes a second rod disposed within the second track such that the second rod does not contact the second interior surface. The shade has a first outer loop wrapped around the first rod, a second outer loop wrapped around the second rod, and a bottom loop. The bottom rail is connected to a first idler end having a first loop portion around the first rod and to a second idler end having a second loop portion around the second rod. The bottom rail is disposed between the first partitions and the second partitions. The first idler end is disposed within the first track, and the second idler end is disposed within the second track. Further, the bottom loop of the shade is wrapped around the bottom rail.

Another embodiment of the invention relates to an anti-ligature shade system. The anti-ligature shade system includes a first track, a first rod disposed within the first track, a second track, and a second rod disposed within the second track. The first rod does not contact the first track, and the second rod not contact the second track. The anti-ligature shade system also includes a shade and a security box. The shade has a first outer loop wrapped around the first rod and a second outer loop wrapped around the second rod. The security box houses a system that is configured to extend and retract the shade. In the anti-ligature shade system, the first track, the second track, the first rod, and the second rod extend from a first lower end to a second upper end that is within the security box.

Another embodiment of the invention relates to a shade system. The shade system includes a first track having a first interior surface and a second track having a second interior surface. The shade system also includes a first rod disposed within the first track such that the first rod does not contact the first interior surface and a second rod disposed within the second track such that the second rod does not contact the second interior surface. Further, the shade system includes a shade having a first outer loop wrapped around the first rod, a second outer loop wrapped around the second rod, and a bottom loop wrapped around a bottom rail. The bottom rail is configured to slide upwardly and downwardly between the first track and the second track when the shade is retracted and extended.

Alternative exemplary embodiments relate to other features and combinations of features as may be generally recited in the claims.

BRIEF DESCRIPTION OF THE DRAWINGS

The disclosure will become more fully understood from the following detailed description, taken in conjunction with the accompanying figures, wherein like reference numerals refer to like elements, in which.

DETAILED DESCRIPTION

Before turning to the figures, which illustrate the exemplary embodiments in detail, it should be understood that the present invention is not limited to the details or methodology set forth in the description or illustrated in the figures. It should also be understood that the terminology is for the purpose of description only and should not be regarded as limiting.

Generally, an anti-ligature shade system is provided. In particular, the shade system is designed such that the shade cannot be pulled from the track assemblies by a patient that may attempt to wrap the shade around his/her neck in an effort to harm himself/herself. Additionally, the shade system is prevented from being bunched up and tied with a cord, i.e., prevented from forming a tie off point, such that the patient could use the cord to inflict harm. In this regard, the shade has outer loops that wrap around rods in the track assemblies such that the shade cannot be gathered to a cinch point. Further, the track assemblies are configured to restrict access to the interior components to further thwart efforts to uncouple the components of the shade system.

Figure 1:
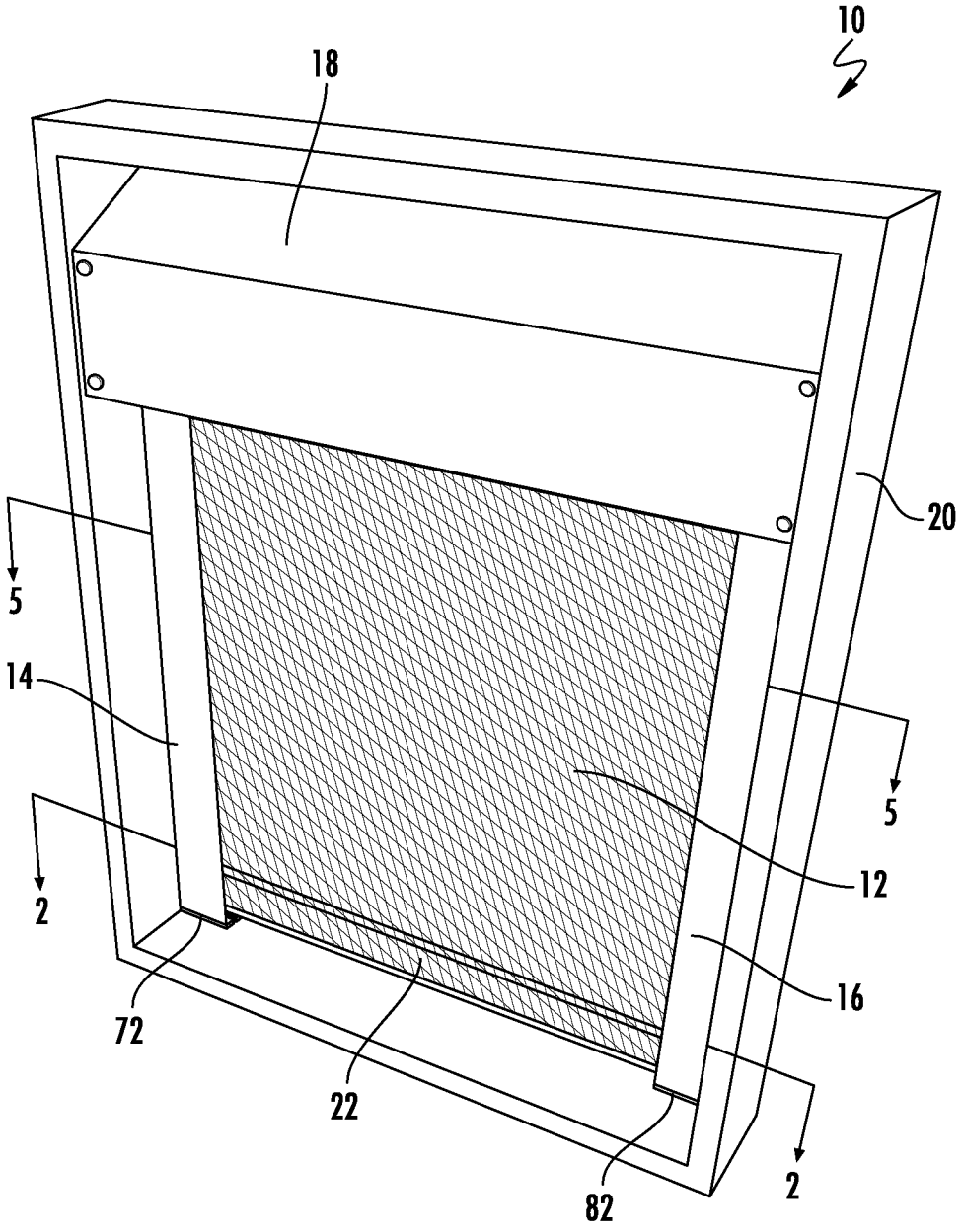
FIG. 1 depicts a perspective view of the shade system, according to an exemplary embodiment.

Referring to the FIG. 1, a shade system 10 is provided, which generally includes a shade 12, a first track assembly 14, and a second track assembly 16. As can be seen, the shade 12 is disposed between the first track assembly 14 and the second track assembly 16, and the shade 12 extends downwardly from and retracts upwardly into a security box 18 that houses a system configured to extend and retract the shade 12. As can also be seen in FIG. 1, the security box 18 is arranged above the first track assembly 14 and the second track assembly 16. As depicted in FIG. 1, the shade system 10 is set into or mounted onto a window frame 20. While the shade system 10 is depicted as being inside the window frame 20 in FIG. 1, in other embodiments, the shade system 10 is mounted outside of the window frame 20, e.g., secured to a wall surrounding the window, and in still other embodiments, the shade system 10 is integrated into the window frame 20. Those of ordinary skill in the art will understand that the size and location of the window frame 20 will vary depending on the architectural design choices of the building in which the window frame 20 is situated and the shade system 10 is generally scalable with the dimensions of the window frame 20.

Figure 2:
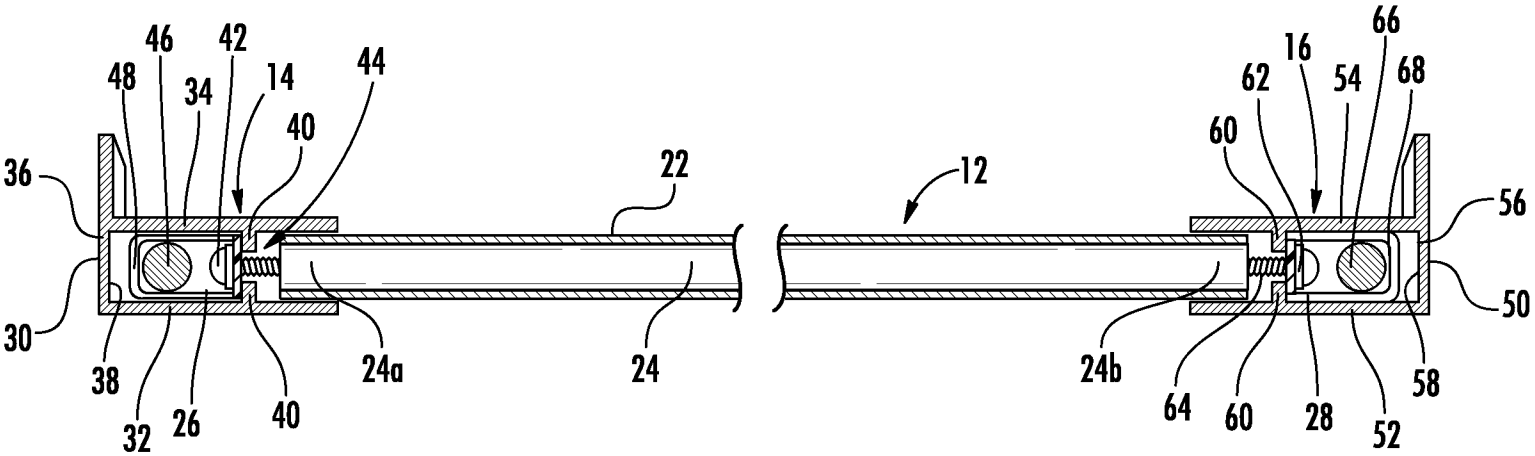
FIG. 2 depicts a cross-sectional view of the shade system of FIG. 1 taken along line 2-2.

As shown in FIG. 1, the shade 12 includes a bottom loop 22. FIG. 2 depicts a cross-sectional view of the shade 12, the first track assembly 14, and the second track assembly 16 taken across the bottom loop 22 of the shade 12. As can be seen in the cross-sectional view of FIG. 2, the shade 12 is wrapped around a bottom rail 24 to form the bottom loop 22. For example, in embodiments, the shade 12 is wrapped around the bottom rail 24 and welded (e.g., RF bar welded, wedge welded, hot air welded, etc.) to itself to form the bottom loop 22. In other embodiments, the shade 12 can be sewn, bonded, or otherwise fastened to itself to form the bottom loop 22, or the bottom loop 22 can be separately formed and attached to the shade 12, such as through welding, sewing, bonding, etc. The bottom rail 24, in part, provides a counter weight for extending the shade 12 and also a gripping bar by which to pull the shade 12 closed. Additionally, the bottom rail 24 provides a first way to attach the shade 12 to the first track assembly 14 and the second track assembly 16. In particular, a first idler end 26 is attached to a first end 24*a* of the bottom rail 24, and a second idler end 28 is attached to a second end 24*b* of the bottom rail 24. The first idler end 26 travels within the first track assembly 14, and the second idler end 28 travels within the second track assembly 16.

The first track assembly 14 is defined by a first track 30 having a generally C-shaped cross-section defined by a first front wall 32, a first rear wall 34 and a first sidewall 36 connecting the first front wall 32 to the first rear wall 34. Extending from a first interior surface 38 of the first track 30 are first partitions 40. The first idler end 26 is on an interior side of the partitions 40 while the first end 24*a* of the bottom rail 24 is on an exterior side of the partitions 40. One or more fasteners, such as screws 42, attach the first idler end 26 to the first end 24*a* of the bottom rail 24, and a first gap 44 is provided between the first partitions 40 such that screws 42 can extend from the first idler end 26 to the first end 24*a* of the bottom rail 24. The first gap 44 extends the length of the first track 30 so that the screws 42 (and thus the bottom rail 24) can move the length of the first track 30. Disposed within the first track 30 is a first rod 46. A first loop portion 48 of the first idler end 26 is positioned around the first rod 46. In this way, the first idler end 26 is able to travel within the first track 30 along the first rod 46.

Similarly, the second track assembly 16 is defined by a second track 50 having a generally C-shaped cross-section defined by a second front wall 52, a second rear wall 54 and a second sidewall 56 connecting the second front wall 52 to the second rear wall 54. Extending from a second interior surface 58 of the second track 50 are second partitions 60. The second idler end 28 is on an interior side of the second partitions 60 while the second end 24*b* of the bottom rail 24 is on an exterior side of the second partitions 60. One or more fasteners, such as screws 62, attach the second idler end 28 to the second end 24*b* of the bottom rail 24, and a second gap 64 is provided between the second partitions 60 such that screws 62 can extend from the second idler end 28 to the second end 24*b* of the bottom rail 24. The second gap 64 extends the length of the second track 50 so that the screws 62 (and thus the bottom rail 24) can move the length of the second track 50. Disposed within the second track 50 is a second rod 66. A second loop portion 68 of the second idler end 28 is positioned around the second rod 66. In this way, the second idler end 28 travels within the second track 50 along the second rod 66.

Figure 3:
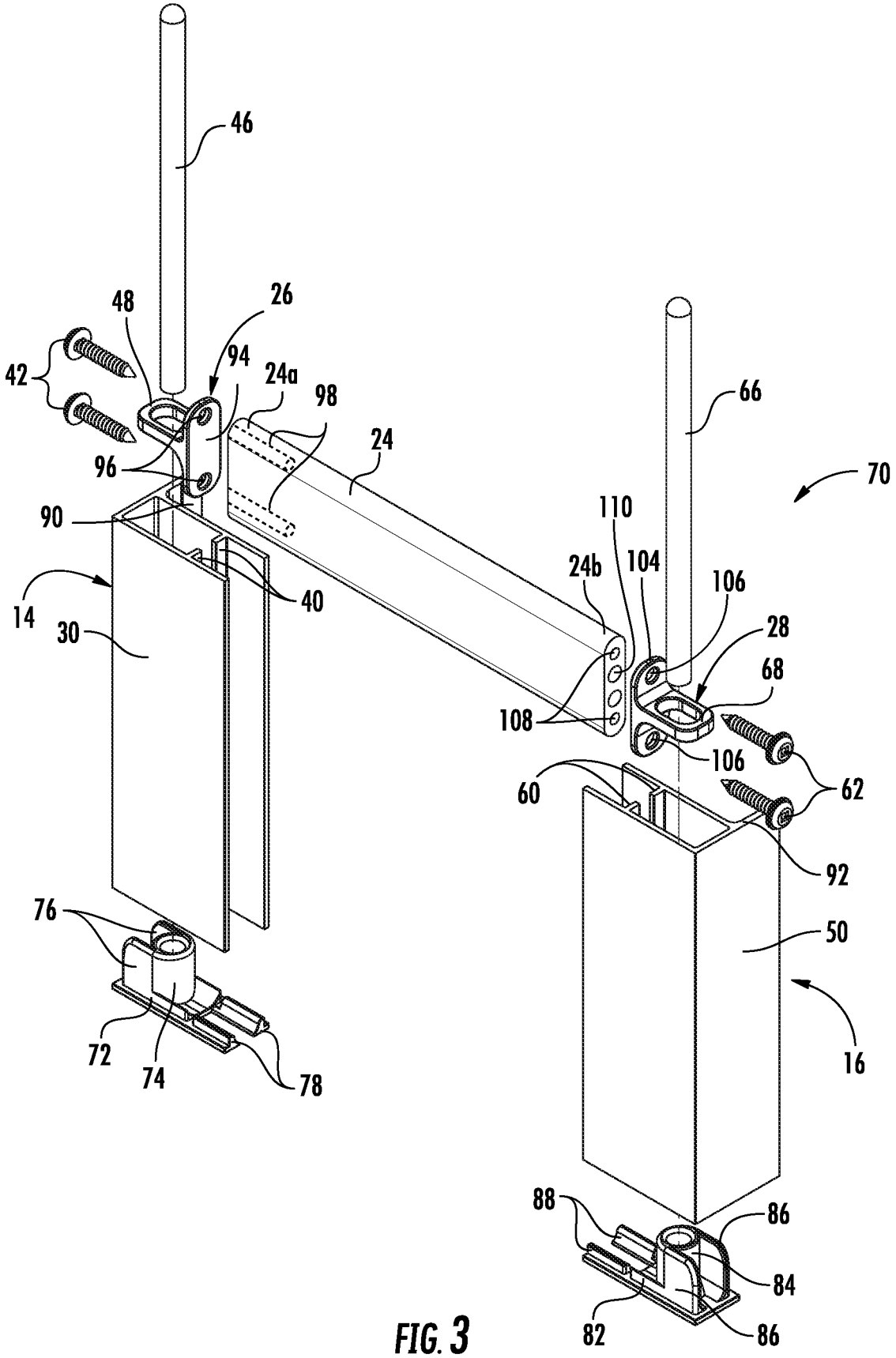
FIG. 3 depicts an exploded view of the track system of the shade system, according to an exemplary embodiment.

The first track assembly 14, the second track assembly 16, the bottom rail 24, the first idler end 26, and the second idler end 28 define a track system 70 as shown in the exploded view of FIG. 3. The first track assembly 14 is connected to a first bottom cap 72. The first bottom cap 72 includes an upwardly-projecting first boss 74, which is supported by one or more first strengthening ribs 76. The first boss 74 is configured to receive the first rod 46. In embodiments, the first rod 46 is secured in the first boss 74 using a sealant or a curable resin bonding agent, such as silicone or an epoxy. In the embodiment depicted, the first bottom cap 72 also includes first contoured legs 78 that are adapted to receive the bottom rail 24 in that the contour of the first contoured legs 78 matches the curvature of the bottom rail 24. Similarly, the second track assembly 16 is connected to a second bottom cap 82. The second bottom cap 82 includes an upwardly-projecting second boss 84, which is supported by one or more second strengthening ribs 86. The second boss 84 is configured to receive the second rod 66. In embodiments, the second rod 66 is secured in the second boss 84 using a sealant or a curable resin bonding agent, such as silicone or an epoxy. In the embodiment depicted, the second bottom cap 82 also includes second contoured legs 88 that are adapted to receive the bottom rail 24 in that the contour of the second contoured legs 88 matches the curvature of the bottom rail 24.

During assembly of the track system 70, the first rod 46 is secured in the first boss 74 of the first bottom cap 72, and the second rod 66 is secured in the second boss 84 of the second bottom cap 82. The rods 46, 66 and bottom caps 72, 82 are inserted into their respective tracks 30, 50. In embodiments, the bottom caps 72, 82 are slid into the tracks 30, 50 to create a tight frictional engagement between the bottom caps 72, 82 and the tracks 30, 50, or the bottom caps 72, 82 are snap-fit into the tracks 30, 50. In embodiments, the bottom caps 72, 82 may also be fastened to the tracks 30, 50 by inserting a screw through the tracks 30, 50 and into the strengthening ribs 76, 86 of the bottom caps 72, 82. As depicted in FIG. 3, the first track 30 includes a first attachment arm 90, and the second track 50 includes a second attachment arm 92. The attachment arms 90, 92 are secured to the window frame 20 using, e.g., tamper-resistant screws. In embodiments, the attachment arms 90, 92 also help to position the tracks 30, 50 in relation to the window pane by abutting the attachment arms 90, 92 against the window pane or other surrounding features. Once the track assemblies 14, 16 are assembled and secured to the frame 20, the bottom rail 24 and idler ends 26, 28 are attached to the track assemblies 14, 16.

As mentioned above, the idler ends 26, 28 are attached to the bottom rail 24 via screws 42, 62. As shown in FIG. 3, the first idler end 26 includes a first attachment portion 94 that is arranged substantially perpendicularly to the first loop portion 48. The first attachment portion 94 includes first through holes 96 through which the screws 42 are inserted. The screws 42 engage first holes 98 in the first end 24*a* of the bottom rail 24. In embodiments, the first holes 98 have a predetermined depth selected such that, when the screws 42 are fully inserted into the first holes 98, the first attachment portion 94 is not brought into tight abutment with the first end 24*a* of the bottom rail 24. In this way, the first idler end 26 is able to loop around the first rod 46 while positioning the first idler end 26 on the interior side of the first partitions 40 and the first end 24*a* of the bottom rail 24 on the exterior side of the first partitions 40. In embodiments, the screws 42 are self-threading screws, and the second holes 98 are not threaded. In this way, the self-threading screws 42 cut the threads into the second holes 98 during installation. However, in other embodiments, the second holes 98 may be threaded holes.

Similarly, the second idler end 28 includes a second attachment portion 104 that is arranged substantially perpendicularly to the second loop portion 68. The second attachment portion 104 includes second through holes 106 through which the screws 62 are inserted. The screws 62 engage second holes 108 in the second end 24*b* of the bottom rail 24. In embodiments, the second holes 108 have a predetermined depth selected such that, when the screws 62 are fully inserted into the second holes 108, the second attachment portion 104 is not brought into tight abutment with the second end 24*b* of the bottom rail 24. In this way, the second idler end 28 is able to loop around the second rod 66 while positioning the second idler end 28 on the interior side of the second partitions 60 and the second end 24*b* of the bottom rail 24 on the exterior side of the second partitions 60. In embodiments, the screws 62 are self-threading screws, and the second holes 108 are not threaded. In this way, the self-threading screws 62 cut the threads into the second holes 108 during installation. However, in other embodiments, the second holes 108 may be threaded holes.

In the embodiment shown in FIG. 3, it can also be seen that the bottom rail 24 includes bores 110. The bores 110 are adapted to receive rods, which provide additional weight to the bottom rail 24. As the bottom rail 24 may be used to counterbalance the system that extends and retracts the shade 12, additional weight may be necessary to achieve the proper balance. Thus, one or more rods can be inserted into the bores 110 to achieve the requisite weighting to smoothly operate the shade 12. As shown in FIG. 3, two bores 110 are provided, but in other embodiments, more or fewer bores 110 (including no bores 110) are used. Further, in embodiments, the bores 110 run the entire length of the bottom rail 24, and in other embodiments, the bores 110 only run a portion of the length of the bottom rail 24. In general, the bores 110 are filled with rods of a material that is denser than the material of the bottom rail 24. For example, if the bottom rail 24 is made of aluminum or an aluminum alloy, then steel rods can be inserted into the bores 110 to increase the weight of the bottom rail 24. Such weighting of the bottom rail 24 may typically occur where the shade system 10 is used with a wide window.

Figure 4:
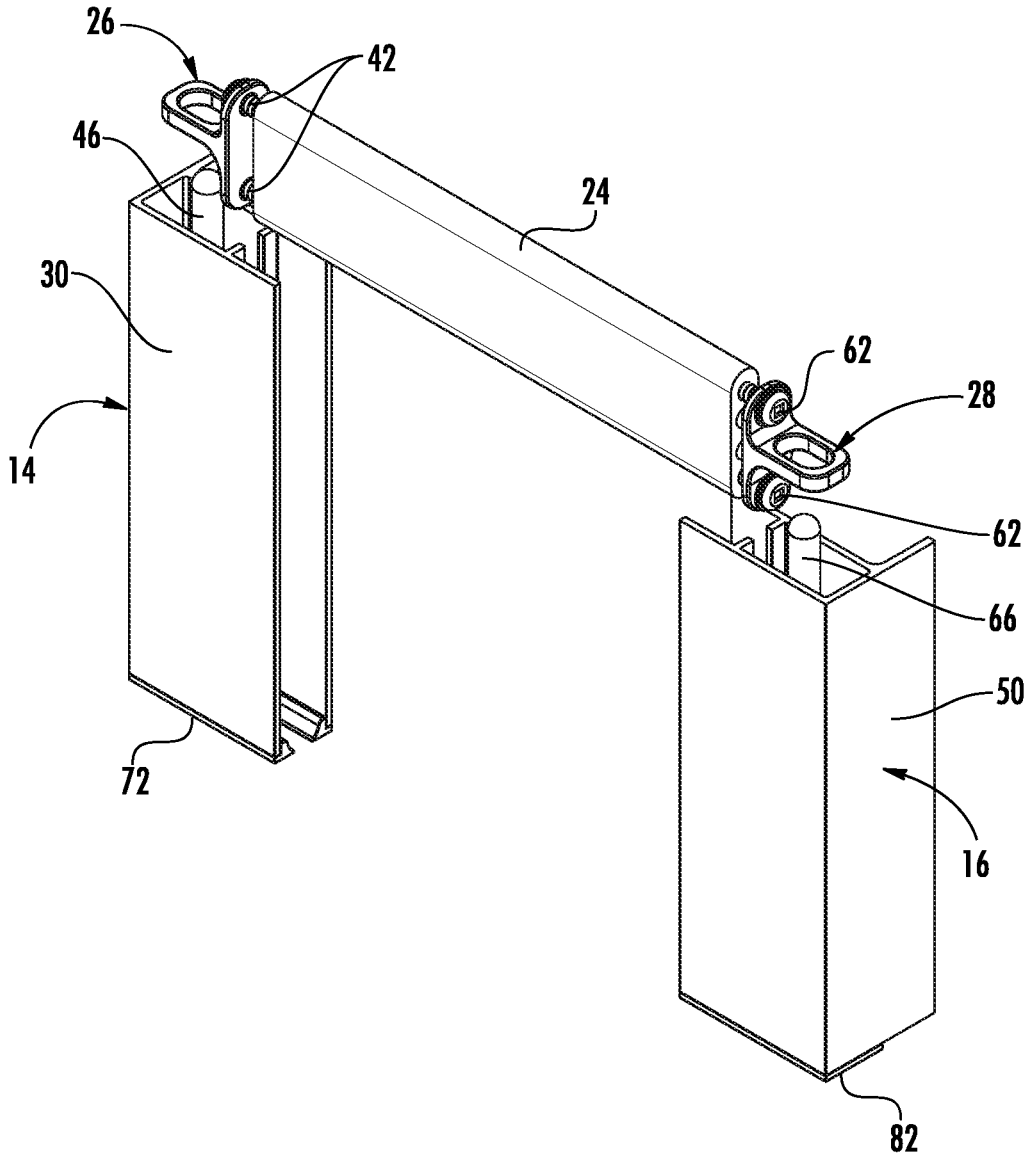
FIG. 4 depicts an assembled view of the track system of FIG. 3.

FIG. 4 depicts the assembled components of the track system 70. While FIG. 4 does not depict the shade 12 so as more clearly illustrate the connection between the track assemblies 14, 16 and the bottom rail 24, it will be understood that the bottom rail 24 will be inserted into the bottom loop 22 of the shade 12 (as shown in FIG. 1) prior to installing the bottom rail 24 on the track assemblies 14, 16.

As mentioned above, the shade system includes outer loops on the shade that prevent the shade from being gathered and cinched. These outer loops can be seen in the cross-sectional view of FIG. 5. In particular, the shade 12 includes a first outer loop 112 and a second outer loop 114. The first outer loop 112 is wrapped around the first rod 46, and the second outer loop 114 is wrapped around the second rod 66. In embodiments, the outer loops 112, 114 are stitched to the window side of the shade 12 so that the loops and stitching 116 are not visible to a person on the interior side of the shade 12. In a behavioral health facility, a patient that can see the stitching may attempt to pick at the stitching 116 if it is known that the outer loops 112, 114 are attached to the shade 12 in this manner. In embodiments, the outer loops 112, 114 are formed by edge-serge stitching and then attached to the shade 12 by a finishing stitch. In embodiments, the outer loops 112, 114 are further hidden by the front walls 32, 52 and the rear walls 34, 54. In particular, the front walls 32, 52 and rear walls 34, 54 extend a distance d past the partitions 40, 60 to limit the view into the gaps 44, 64 through which the outer loops 112, 114 could be viewed. In exemplary embodiments, the distance d is from about 0.25" to about 1"; however, in other embodiments, the distance d may vary based on the requirements of the installation and/or the needs of a particular customer.

In embodiments, the outer loops 112, 114 are a different material than shade 12. For example, the material of the shade 12 may be shade cloth, e.g., woven polyethylene or polycarbonate fibers, of various densities and the material of the outer loops 112, 114 may be polyester or a polyester blend. In other embodiments, the shade 12 is made of a single material. In such embodiments, the outer loops 112, 114 can be separately formed and attached to the shade 12, or the outer loops 112, 114 can be formed from the same section of fabric as used for the shade 12. In the latter embodiment, the fabric for the shade 12 can be folded on itself to form the outer loops 112, 114 and then welded, sewn, bonded, or otherwise fastened to itself.

Figure 5:
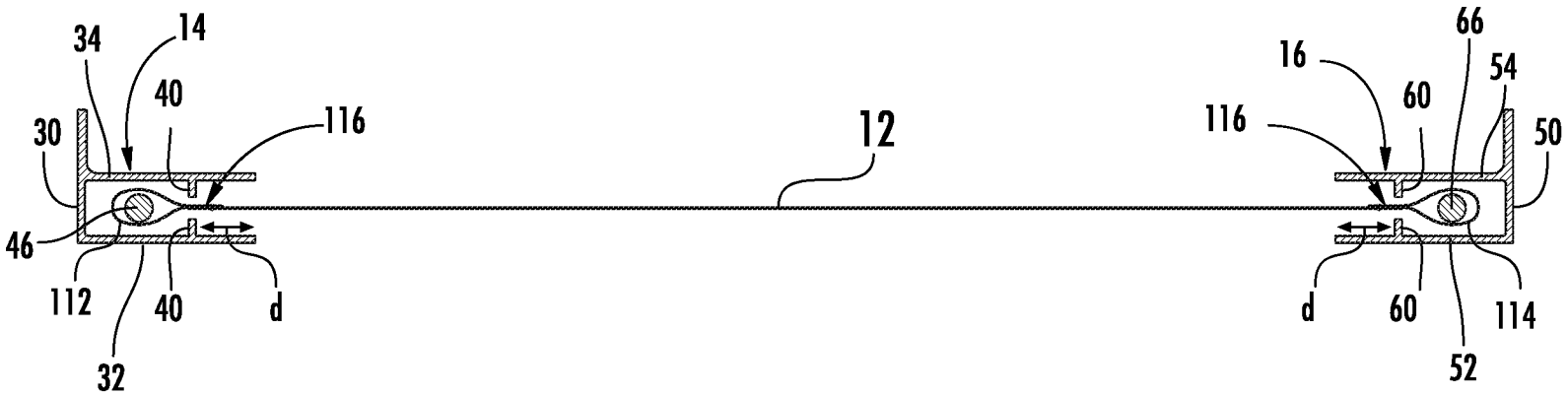
FIG. 5 depicts a cross-sectional view of the shade system of FIG. 1 taken along line 5-5.

The outer loops 112, 114 are wrapped around the rods 46, 66 so that, when a patient pulls on the shade, the outer loops 112, 114 pull on the rods 46, 66, which are limited in their movement by the tracks 30, 50. As can be seen in FIG. 5, the first rod 46 and the second rod 66 "float" in their respective tracks 30, 50. That is, the first rod 46 is not connected along its length to the first track 30, and the second rod 66 is not connected along its length to the first track 50. This allows the rods 46, 66 to flex within the tracks 30, 50 when the shade 12 is pulled; however, the rods 46, 66 are surrounded in close proximity by the front walls 32, 52, the rear walls 34, 54, the sidewalls 36, 56, and the partitions 40, 60 to prevent the rods 46, 46 from flexing to the point where the rods 46, 66 are permanently deformed. For this purpose, the rods 46, 66 are made of aluminum or an aluminum alloy in embodiments. Other metal, plastic, or wood materials are suitable for use as rods 46, 66 in other embodiments. Additionally, because the rods 46, 66 may be pulled against the tracks 30, 50, the tracks 30, 50 are made of a resilient material in embodiments. For example, in an embodiment, the tracks 30, 50 are extruded aluminum or aluminum alloy components. Advantageously, the aluminum or aluminum alloy can be powder coated or anodized to provide a desired color. In other embodiments, the tracks 30, 50 can be made of other metals or plastics.

Besides allowing for flex, the rods 46, 66 are also designed to float in their tracks 30, 50 so that movement of shade 12 is not impeded by any connections between the rods 46, 66 and the tracks 30, 50. That is, as the shade 12 is extended and retracted, the outer loops 112, 114 will move along the rods 46, 66, and connection points between the rods 46, 66 and the tracks 30, 50 would impede such movement.

Figure 6:
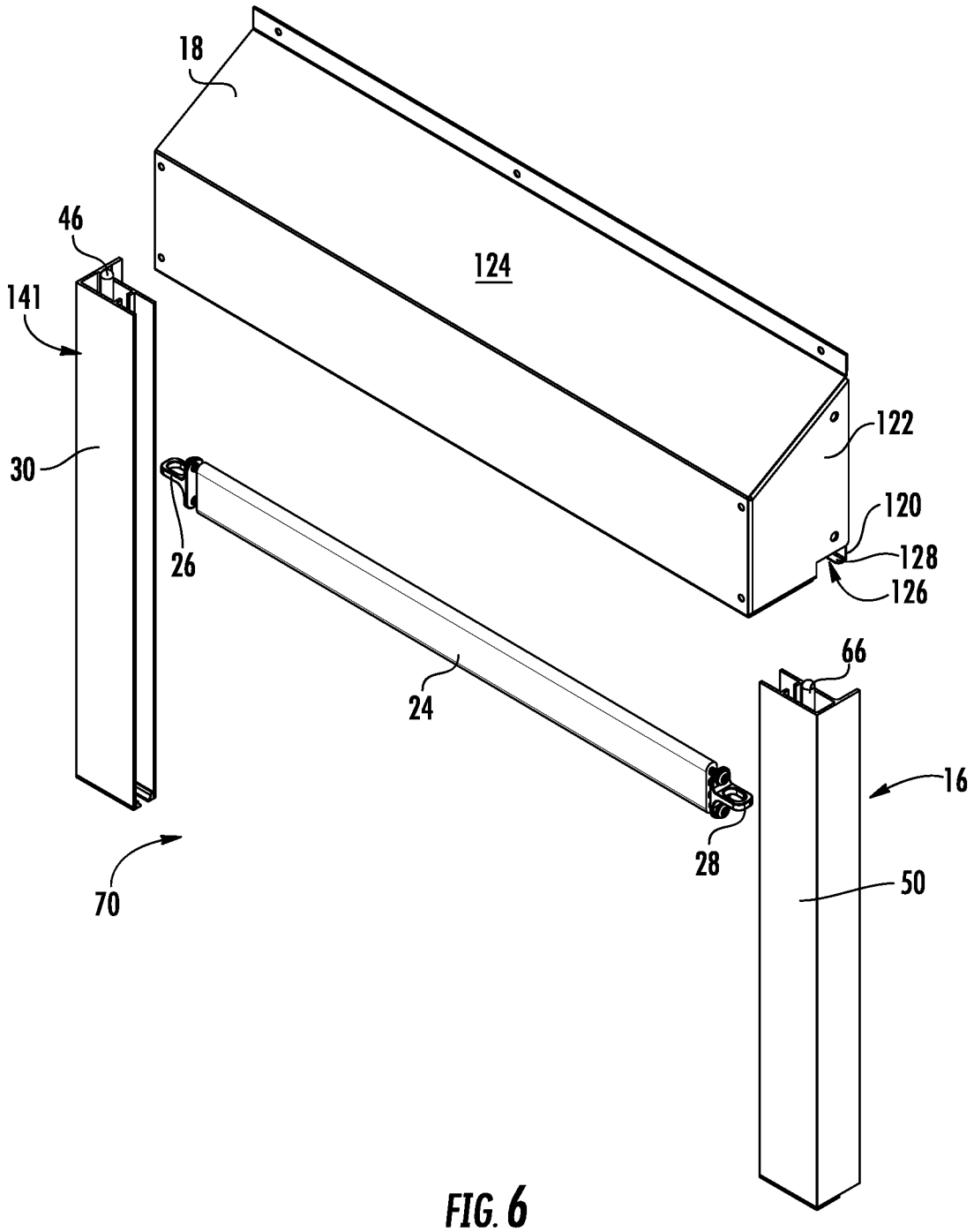
FIG. 6 depicts the track system and the security box in an exploded view.

FIG. 6 shows the track system 70 and the security box 18 in an exploded view. As can be seen in this view, the rods 46, 66 extend past their respective tracks 30, 50. This facilitates installation of the shade 12 on the rods 46, 66 and ensures that the outer loops 112, 114 will not slip off the rods 46, 66 when the shade 12 is retracted into the security box 18. The security box 18 is positioned above the track assemblies 14, 16 and houses a shade retracting/extending system, such as, for example, a roller system (e.g., a spring-assist roller). In the embodiment depicted, the security box 18 includes a back panel 120, two side panels 122, and a front panel 124. In the embodiment depicted, the front panel 124 is angled so as to eliminate looping points from which a patient could attach a ligature; however, in other embodiments, the front panel 124 can be square, curved, or multi-faceted depending on the needs of the installation and/or aesthetics.

Figure 7:
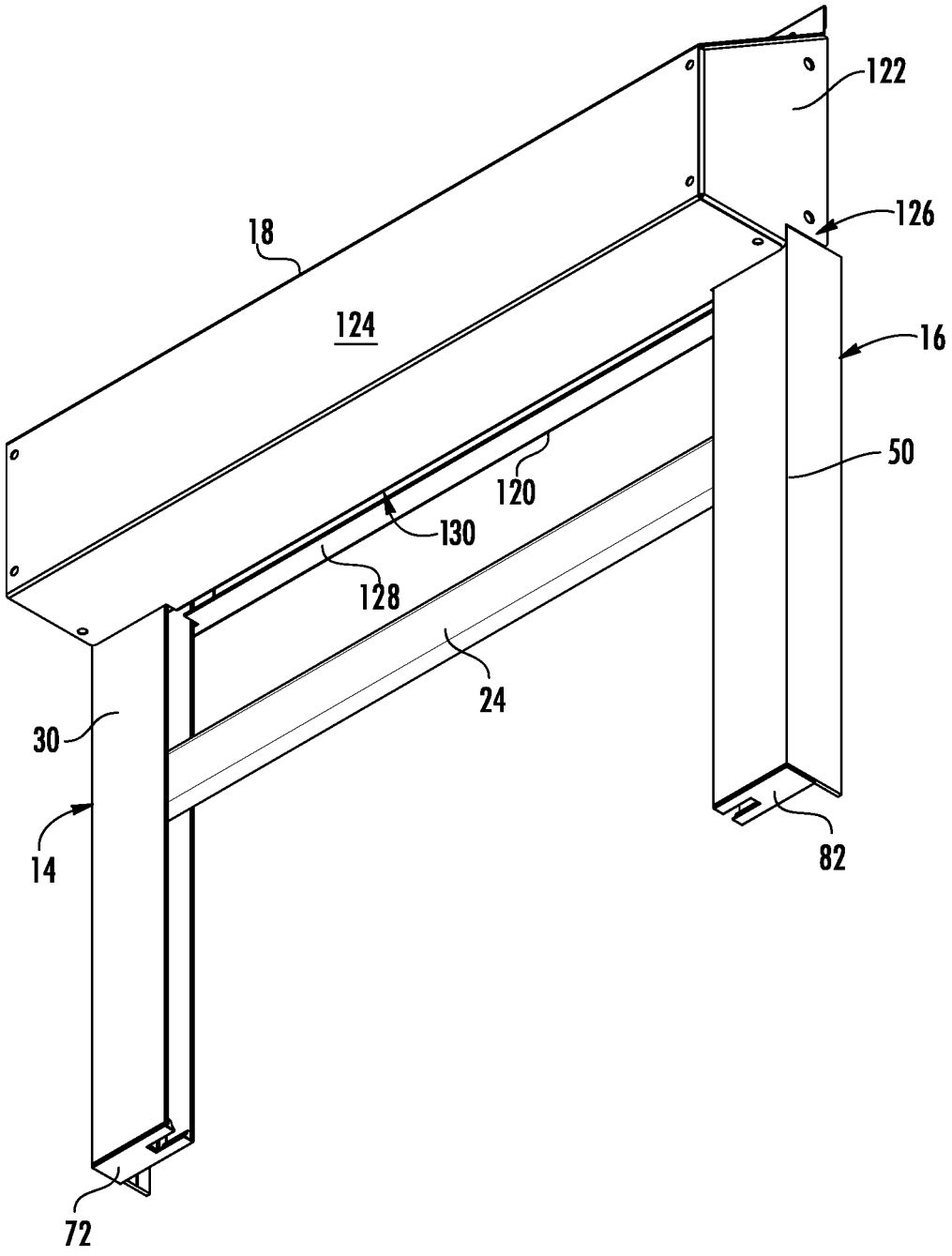
FIG. 7 depicts an assembled view of the track system and the security box of FIG. 6.

As shown in FIG. 6, each side panel 122 of the security box 18 includes a cutout corner section 126 into which the tracks 30, 50 are able to be inserted, which can be seen in the assembled view of FIG. 7. By inserting the tracks 30, 50 into the security box 18, tampering with the shade 12, track assemblies 14, 16, and roller system becomes more difficult because the connections between the components are difficult to view and to access. Additionally, in the embodiment depicted, the back panel 120 includes a lip 128 that also helps prevent tampering with the interior of the security box 18. In particular, the lip 128 of the back panel 120 and the front panel 124, when assembled, provide a narrow gap 130 of just enough width to allow the shade 12 to pass in and out of the security box 18, while substantially preventing a patient from passing his/her fingers through the narrow gap 130. To further obscure the components of the shade system 10, any spaces between the components, such as between the tracks 30, 50 and the security box 18, can be sealed, e.g., with caulk. Additional measures can be taken to make the shade system 10 tamper resistant, such as using tamper-resistant screws at least in areas that are visible/accessible from the exterior of the shade system 10.

In this way, an anti-ligature shade system 10 is provided in which the shade 12 is prevented from being gathered and cinched by the outer loops 112, 114 that wrap around the rods 46, 66 in the track assemblies 14, 16. Additionally, the bottom rail 24 is connected to idler ends 26, 28 having loop portions 48, 68 around the rods 46, 66 so that the bottom rail 24 can also not be pulled from the shade system 10.

In various exemplary embodiments, the relative dimensions, including angles, lengths and radii, as shown in the Figures are to scale. Actual measurements of the Figures will disclose relative dimensions and angles of the various exemplary embodiments. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A shade system, comprising:

a first track assembly, including:

a first track having a first interior surface defined by a first front wall, a first rear wall, a first sidewall, and two first partitions, one of the first partitions extending from the first front wall and the other of the first partitions extending from the first rear wall; and a first rod disposed within the first track such that the first rod does not contact the first interior surface;

a second track assembly, including:

a second track having a second interior surface defined by a second front wall, a second rear wall, a second sidewall, and two second partitions, one of the second partitions extending from the second front wall and the other of the second partitions extending from the second rear wall; and a second rod disposed within the second track such that the second rod does not contact the second interior surface;

a shade having a first outer loop wrapped around the first rod, a second outer loop wrapped around the second rod, and a bottom loop;

a security box housing a system that extends and retracts the shade, wherein the first and second rods extend into the security box and beyond an upper edge of the first and second tracks, respectively; and a bottom rail, the bottom rail being connected to a first idler end having a first loop portion around the first rod and to a second idler end having a second loop portion around the second rod, wherein the bottom rail is disposed between the first partitions and the second partitions, wherein the first idler end is disposed within the first track, wherein the second idler end is disposed within the second track, and wherein the bottom loop of the shade is wrapped around the bottom rail.

2. The shade system of claim 1, wherein the shade is made of a first material and wherein the first outer loop and the second outer loop are made of a second material, the second material being different from the first material.

3. The shade system of claim 2, wherein the first material comprises shade cloth and wherein the second material comprises polyester or a polyester blend.

4. The shade system of claim 2, wherein the shade has an exterior side opposite a room-facing interior side and wherein the first outer loop and the second outer loop are attached to the exterior side of the shade.

5. The shade system of claim 1, wherein the first rod and the second rod are each made of aluminum or an aluminum alloy.

6. The shade system of claim 1, wherein the first track assembly further comprises a first bottom cap, the first bottom cap having a first boss configured to receive the first rod, and wherein the second track assembly further comprises a second bottom cap, the second bottom cap having a second boss configured to receive the second rod.

7. The shade system of claim 1, wherein the first front wall extends at least 0.25" past the first partitions and wherein the second front wall extends at least 0.25" past the second partitions.

8. The shade system of claim 1, wherein the security box is disposed at a first end of the first track assembly and of the second track assembly.

9. The shade system of claim 8, wherein the first track and the second track extend into the security box.

10. The shade system of claim 9, wherein the first rod extends further into the security box than the first track and wherein the second rod extends further into the security box than the second track.

11. The shade system of claim 8, wherein the security box has a square or angled front panel.

12. The shade system of claim 1, wherein the first track and the second track are aluminum or an aluminum alloy.

13. An anti-ligature shade system, comprising:

a first track;

a first rod disposed within the first track, the first rod not contacting the first track;

a second track;

a second rod disposed within the second track, the second rod not contacting the second track;

a shade having a first outer loop wrapped around the first rod and a second outer loop wrapped around the second rod; and a security box housing a system configured to extend and retract the shade;

wherein the first track, the second track, the first rod, and the second rod extend from a first lower end to a second upper end that is within the security box; and wherein the first and second rods extend beyond an upper edge of the first and second tracks, respectively.

14. The anti-ligature shade system of claim 13, further comprising a bottom rail, the shade further having a bottom loop in which the bottom rail is disposed, wherein the bottom rail is connected to a first idler end that loops around the first rod and to a second idler end that loops around the second rod.

15. The anti-ligature shade system of claim 14, wherein the first track includes first partitions that separate the first idler end from the bottom rail and wherein the second track includes second partitions that separate the second idler end from the bottom rail.

16. The anti-ligature shade system of claim 13, wherein the shade is made of a first material and wherein the first outer loop and the second outer loop are made of a second material, the second material being different from the first material.

17. The anti-ligature shade system of claim 16, wherein the first material comprises shade cloth and wherein the second material comprises polyester or a polyester blend.

18. The anti-ligature shade system of claim 13, wherein the first rod and the second rod are each made of aluminum or an aluminum alloy.

19. A shade system, comprising:

a first track having a first interior surface;

a first rod disposed within the first track such that the first rod does not contact the first interior surface;

a second track having a second interior surface;

a second rod disposed within the second track such that the second rod does not contact the second interior surface;

a security box, wherein the first and second rods extend into the security box and beyond an upper edge of the first and second tracks, respectively; and a shade having a first outer loop wrapped around the first rod, a second outer loop wrapped around the second rod, and a bottom loop wrapped around a bottom rail, the bottom rail being configured to slide upwardly and downwardly between the first track and the second track when the shade is retracted and extended.

* * * * *